US006474981B1

(12) United States Patent
Morgan

(10) Patent No.: US 6,474,981 B1
(45) Date of Patent: Nov. 5, 2002

(54) CO-AXIAL FURNACE BLOWER WITH SIMPLIFIED CONSTRUCTION

(75) Inventor: Donald Morgan, Florissant, MO (US)

(73) Assignee: Emerson Electric Co., St. Louis, MO (US)

( * ) Notice: Subject to any disclaimer, the term of this patent is extended or adjusted under 35 U.S.C. 154(b) by 40 days.

(21) Appl. No.: 09/671,786

(22) Filed: Sep. 27, 2000

(51) Int. Cl.[7] ..... F23D 14/46

(52) U.S. Cl. ..... 431/350; 431/353; 417/371; 417/423.1; 417/423.14

(58) Field of Search ..... 431/264, 265, 431/266, 250, 353, 168, 169; 237/12.3 C; 415/208.5, 220, 218.1, 222, 219.1, 211.2, 214.1; 126/401, 409, 110 C, 110 B; 432/222; 417/371, 423.1, 423.14; 34/96, 97

(56) References Cited

U.S. PATENT DOCUMENTS

| | | | | |
|---|---|---|---|---|
| 1,928,839 | A | * | 10/1933 | Marsden |
| 2,159,414 | A | * | 5/1939 | Wilcox et al. |
| 3,193,265 | A | * | 7/1965 | Cowen |
| 3,346,174 | A | * | 10/1967 | Lievens et al. |
| 3,383,700 | A | * | 5/1968 | Taylor |
| 4,309,978 | A | | 1/1982 | Hensiek et al. |
| 4,430,808 | A | * | 2/1984 | Toyomi et al. |
| 4,767,914 | A | * | 8/1988 | Glucksman |
| 4,903,416 | A | * | 2/1990 | Levins |
| RE34,154 | E | * | 1/1993 | Lee |
| 5,244,275 | A | * | 9/1993 | Bauer et al. |
| 5,839,205 | A | * | 11/1998 | Hung |

FOREIGN PATENT DOCUMENTS

| | | | | |
|---|---|---|---|---|
| CA | 718303 | * | 9/1965 | |
| DE | 1 551 726 | * | 3/1970 | |
| JP | 44-17352 | * | 7/1969 | |
| JP | 62-41559 | * | 2/1987 | ..... 431/344 |
| JP | 3-102109 | * | 4/1991 | ..... 431/265 |
| JP | 7-63322 | * | 3/1995 | ..... 431/344 |

* cited by examiner

*Primary Examiner*—Carl D. Price
(74) *Attorney, Agent, or Firm*—Thompson Coburn LLP

(57) ABSTRACT

A furnace blower has an inexpensive and compact coaxially arranged simplified construction that includes an electric motor having a shell with radially projecting fins that is press-fit into a cylindrical blower housing and a combustion tube that is also press-fit into the blower housing where the interior of a combustion tube is positioned in close proximity to a fan on the motor shaft. The press-fit assembly of the motor into the blower housing as well as the combustion tube into the blower housing simplifies the construction of the furnace blower and reduces its manufacturing costs. The furnace blower is also smaller than prior art furnace blowers which enables it to be readily retrofit into conventional furnaces in place of prior art furnace blowers.

14 Claims, 4 Drawing Sheets

CO-AXIAL FURNACE BLOWER WITH SIMPLIFIED CONSTRUCTION

BACKGROUND OF THE INVENTION (1) Field of the Invention

The present invention pertains to a furnace blower having a co-axially arrange and simplified construction. More specifically, the furnace blower comprises an electric motor press-fit into a cylindrical blower housing and a nozzle that is also press-fit into the blower housing. The motor has a shaft with a fan mounted on the shaft and positioned in the nozzle. The press-fit assembly of the motor into the blower housing as well as the nozzle into the blower housing simplifies the construction of the furnace blower and reduces its manufacturing costs. The furnace blower is also smaller than prior art furnace blowers which enables it to be readily retrofit into conventional furnaces in place of the prior art furnace blower.

(2) Description of the Related Art

A prior art furnace blower 10 is shown in FIGS. 1 and 2. Prior art furnace blowers, and in particular oil burner furnace blowers typically include an electric motor 12 mounted to the side of a fan housing 14 that encloses a squirrel cage fan (not shown). The fan housing 14 also supports an oil pump 16 of the furnace and a blower nozzle 18 that directs a flow of air generated by the squirrel cage fan into the combustion chamber of the furnace.

The fan housing of these prior art furnace blowers is constructed of two housing sections 22, 24 that are cast of metal. With the housing sections being cast, it is necessary to machine surfaces on the exterior of the housing sections to provide flat, smooth surfaces to which the motor 12, the oil pump 16 and the blower nozzle 18 can be mounted. The two housing sections 22, 24 are also machined to provide flat, smooth surfaces where they are joined together. It is also necessary to machine interior surfaces of the cast housing sections that receive axially aligned bearings (not shown) that support the shaft of the squirrel cage fan. The machining steps required of the fan housing sections significantly contribute to the overall cost of manufacturing the furnace blower.

In addition, the motor, oil pump and blower nozzle are secured to the fan housing sections by fasteners, for example, threaded screws and bolts. Assembling these component parts to the housing sections with the threaded fasteners contributes significantly to the time required to assemble the furnace blower and thereby also increases the assembly's cost of manufacture.

SUMMARY OF THE INVENTION

What is needed to overcome the disadvantages of the prior art furnace blower constructions is an improved construction of a furnace blower that reduces the number of component parts of the blower and simplifies its assembly. The furnace blower of the invention provides these advantages.

The furnace blower of the invention is contained in a cylindrical housing having inlet and outlet ends at axially opposite ends of the housing. The shell of the electric motor employed in the blower is formed of extruded aluminum and has three radially projecting fins. The radially projecting fins are press-fit into the interior of the cylindrical blower housing and center the electric motor coaxially in the housing with a radial spacing between the motor shell and the interior surface of the housing. The radial spacing allows a flow of air through the inlet end of the housing and around the motor as the motor is operated, thereby cooling the motor. A shaft of the motor projects into the motor housing and a fan is mounted on the shaft. The fan is not a squirrel cage fan as employed in prior art blowers, but a fan with radially projecting blades.

A combustion tube is also coaxially press fit into the interior of the blower housing. The combustion tube has an inlet opening and an axially opposite outlet opening and tapers as its extends between its inlet and outlet openings. In the preferred embodiment the combustion tube tapers through a curve as it extends from its inlet opening to its outlet opening. The inlet opening of the combustion tube is press fit into the interior of the cylindrical housing. The cylindrical housing has a circular end wall at its outlet end and the end wall has a circular opening that engages around an intermediate portion of the combustion tube and provides further support to the combustion tube in the housing.

The construction of the furnace blower of the invention is smaller than that of prior art furnace blowers which enables the furnace blower to be retrofit into most exiting furnaces. The combustion tube outlet end is dimensioned the same size as prior art furnace blowers which also facilitates retrofitting the furnace blower of the invention to existing furnaces. The simplified press fit construction of the furnace blower reduces the number of its component parts and the time required for its manufacture, thus significantly reducing its cost of manufacture from that of prior art furnace blowers.

BRIEF DESCRIPTION OF THE DRAWINGS

Further features of the invention are set forth in the following detailed description of the preferred embodiment of the invention and in the drawing figures wherein.

DETAILED DESCRIPTION OF THE PREFERRED EMBODIMENT

Figure 1:
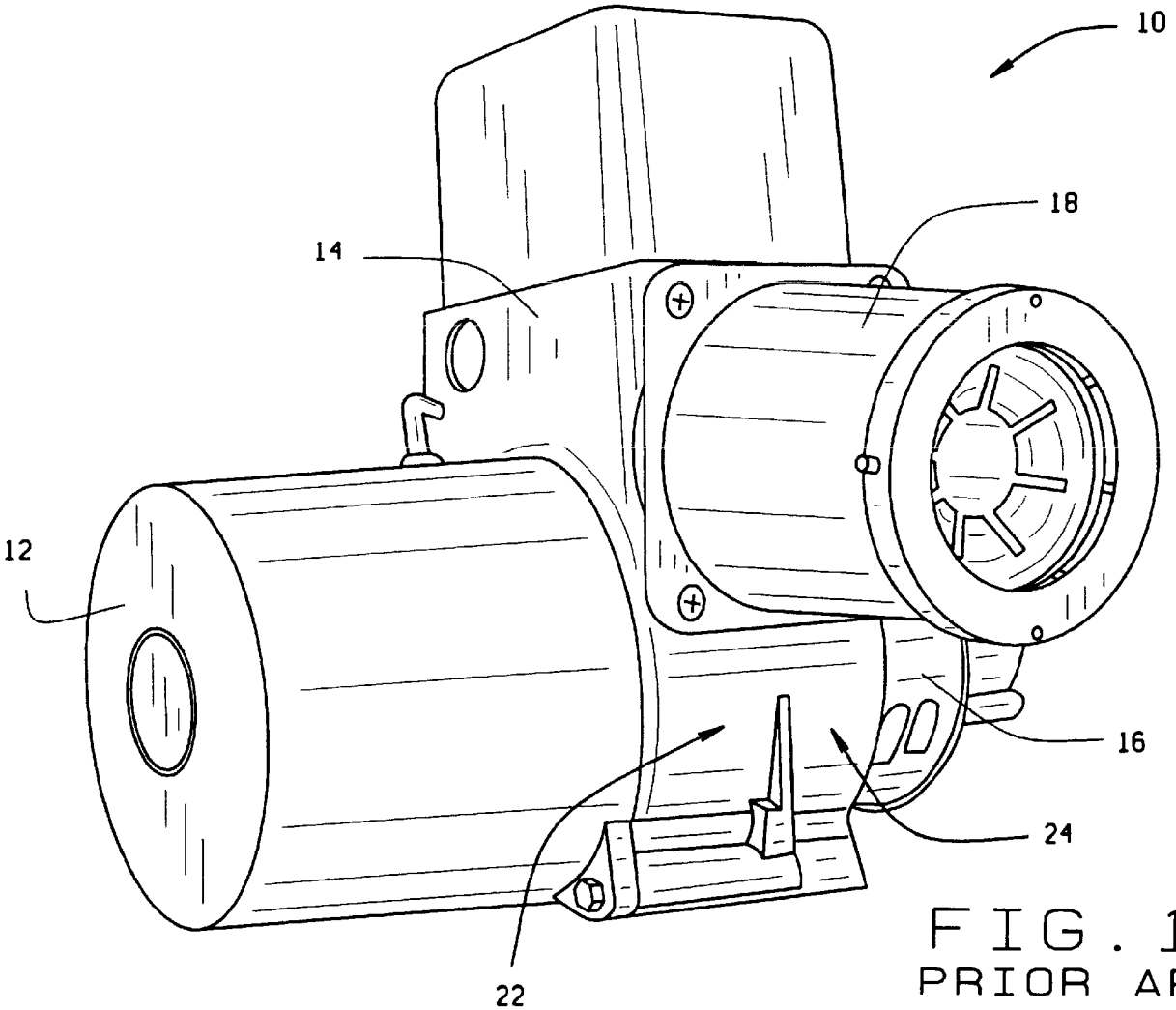
FIG. 1 PRIOR ART
FIG. 1 is a perspective view of a prior art furnace blower.
Figure 2:
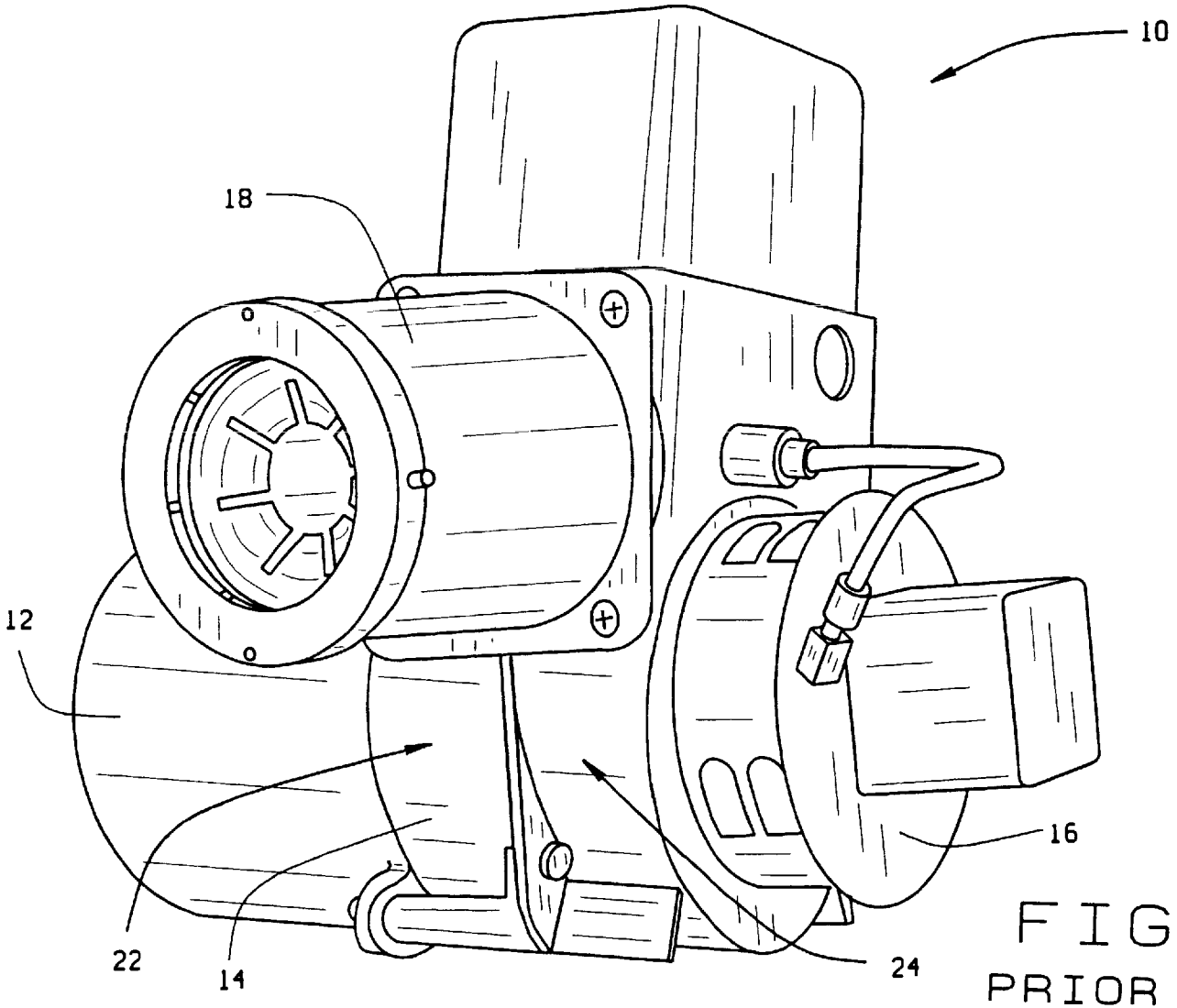
FIG. 2 PRIOR ART
FIG. 2 is a perspective view of the prior art furnace blower showing the opposite side of the blower from that of FIG. 1.
Figure 3:
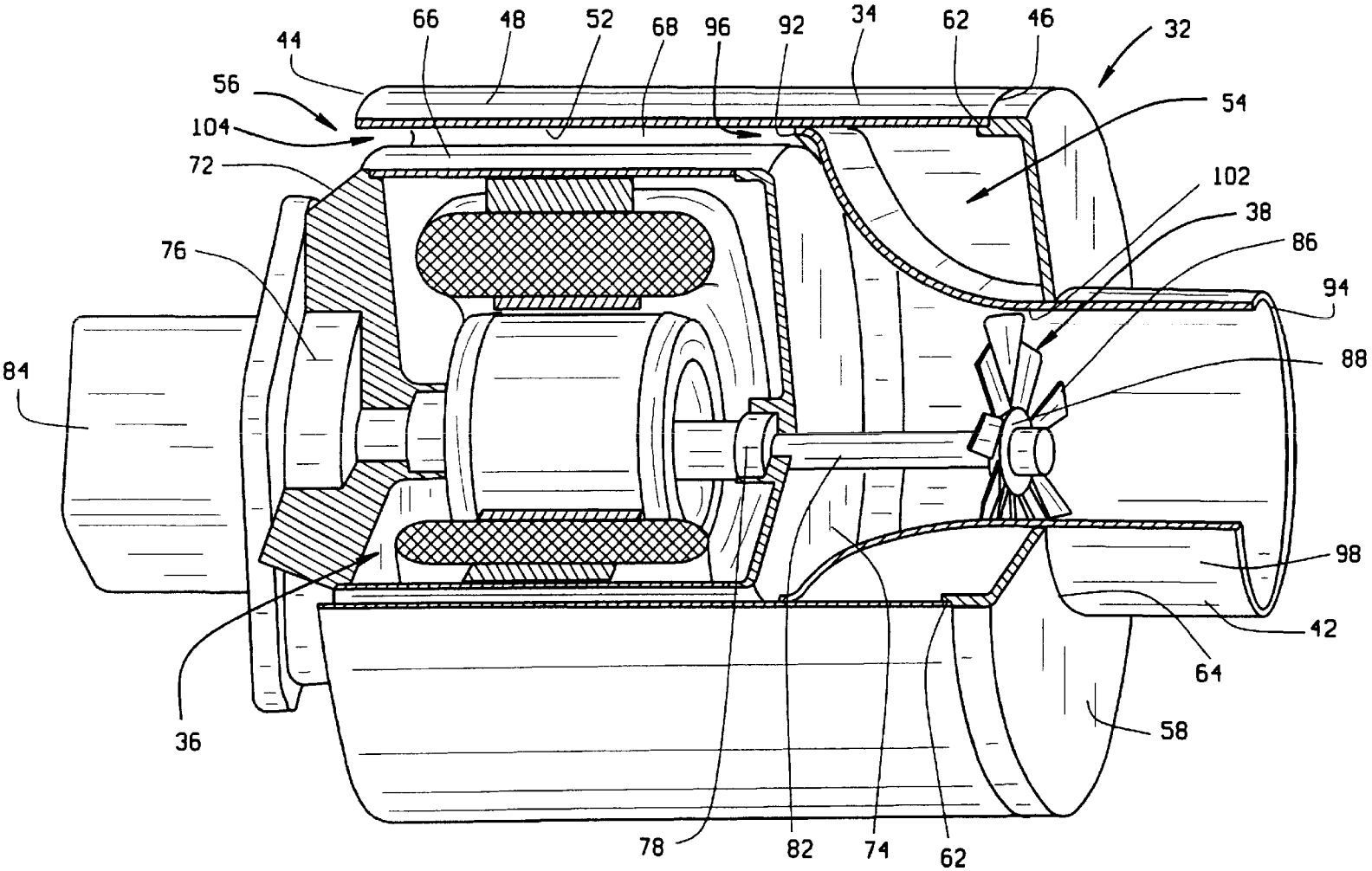
FIG. 3 is a partially cut away side perspective view of the furnace blower of the invention.
Figure 5:
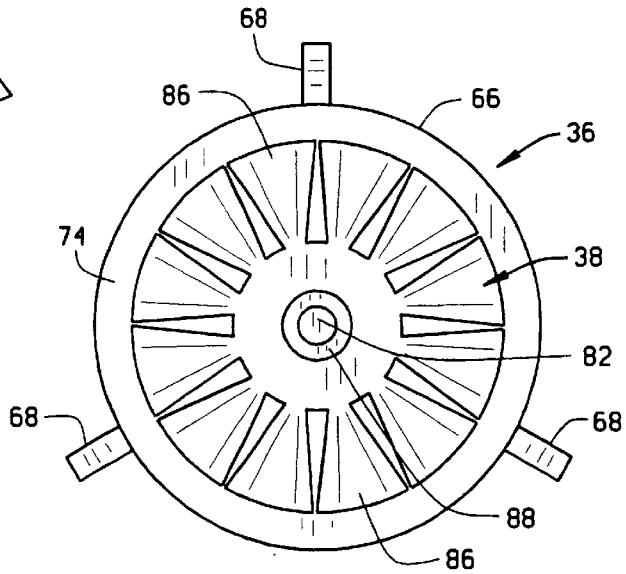
FIG. 5 is an end view of the motor and fan of FIG. 4.
Figure 4:
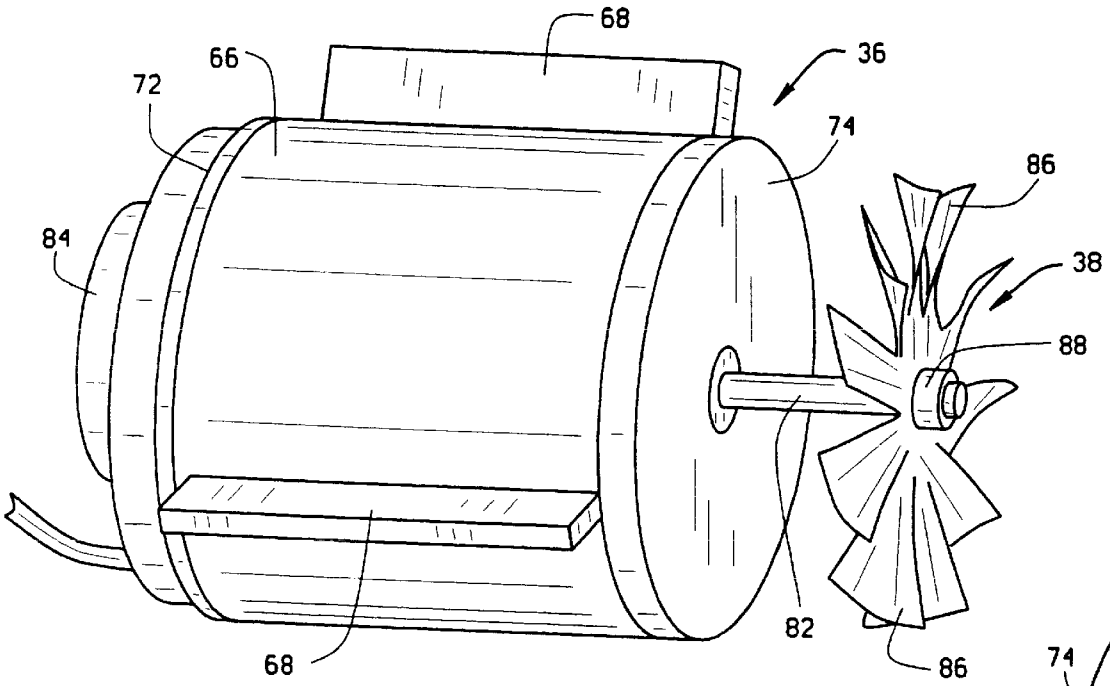
FIG. 4 is a side perspective view of the motor and fan of the furnace blower.

The furnace blower 32 of the invention is shown in FIGS. 3, 4 and 5. The furnace blower has a more simplified construction from those of the prior art and is basically comprised of a blower housing 32, a motor 36, a fan 38 and a combustion tube 42.

The blower housing 34 is formed as a stamped steel construction as opposed to case iron employed in manufacturing blower housings of the prior art. The housing 34 is formed as a cylindrical tube with an axial length between a first end 44 and a second end 46 of the cylinder that is sufficiently large to contain the motor 36 within the housing. The housing has an exterior surface 48 and an opposite interior surface 52 that surrounds a hollow interior volume 54 of the housing. The first end 44 of the housing defines an inlet end 56 of the furnace blower as will be explained. A circular housing end wall 58 is press-fit into the second end 46 of the cylindrical housing 34. The end wall 58 is also preferably of stamped steel construction as opposed to the cast iron construction of prior art furnace blower housings.

The end wall 58 is formed with an annular shoulder 62 around its periphery that is press-fit into the blower housing second end 46 and engages in a friction fit connection against the housing interior surface 52 as shown in FIG. 3. By a press-fit connection between the blower housing 34 and the end wall shoulder 62 what is meant is a tight friction fit or interference fit between these component parts that enables them to be held securely together without the use of separate fasteners as is necessary in assembling cast iron housing sections of prior art furnace blowers. The housing end wall 58 is also provided with a circular opening 64 at its center that defines the second end opening of the blower housing 34.

The motor 36 employed in the furnace blower 32 could be any electrical motor but in the preferred embodiment is an induction motor which provides the advantages of high speed operation and the ability to control speeds of operation. The novel feature of the motor of the furnace blower 32 is that it is constructed with a cylindrical, extruded aluminum shell 66 that includes a plurality of fins 68 that are formed as one piece or monolithically with the cylindrical shell 66. The extruded aluminum construction of the shell 66 and its fins 68 provides the benefit of improved heat transfer from the motor 36 over that of stamped steel construction often used in shells of prior art electric motors. The radial fins 68 also function as a mounting mechanism for the motor as will be explained. The fins 68 preferably extend the axial length of the motor shell 66 and all extend the same radial distance from the motor shell. In the preferred embodiment there are three fins 68 spacially arranged around the motor as shown in FIG. 5. The motor 36 also includes opposite end caps 72, 74. The two end caps support a pair of bearings 76, 78 that also support a shaft 82 of the motor. The motor also supports the oil pump 84 attached to one of its end caps.

The fan 38 is secured to an end of the motor shaft 82 that projects from the motor 36 into the housing interior volume 54. The blower fan 38, unlike prior art furnace blower squirrel cage fans, is a bladed fan with a plurality of fan blades 86 that extend radially outwardly from a center hub 88 of the fan. The use of an induction motor 36 and its high speed operation enable the use of a bladed fan 38 in the furnace blower 32. The high speed operation of the motor and fan enables the fan to push a flow of air through the blower housing 34 that is comparable to that of a squirrel cage fan employed in prior art furnace blowers. In addition, the use of the bladed fan 38 instead of a squirrel cage fan reduces the overall size of the furnace blower 32.

The combustion tube 42 is also preferably of stamped steel construction. As seen in FIG. 3, the combustion tube 42 has a general conical configuration with an axial length between an input end 92 and output end 94 of the combustion tube. The combustion tube input end 92 defines a circular inlet opening 96 of the combustion tube. The input end has a cylindrical dimension that enables the input end 92 to be press-fit into the interior of the blower housing 34 where the exterior surface 98 of the nozzle engages in a tight friction fit or interference fit with the interior surface 52 of the housing. As shown in FIG. 3, the combustion tube tapers through a curve as it extends from its input end 92 to its output end 94 which is positioned outside the blower housing 34. As the combustion tube tapers toward its output end 94 its exterior surface 98 engages in a press-fit connection with the housing second end opening 64 in the center of the housing end wall 58. In addition, as the combustion tube tapers from its input end to its output end 94 the combustion tube interior surface 102 comes in close proximity to the fan blades 86 of the fan 38 mounted on the motor shaft 82. This enables the fan 38 to produce air at a high static pressure through the furnace blower 32.

In assembling the component parts of the furnace blower 32, the fan 38 is first mounted on the motor shaft 82 at a predetermined axial position on the motor shaft and is secured in place. The motor 36 is then inserted into the blower housing 34 through the first end 44 of the housing. The radial fins 68 of the motor are press-fit against the housing interior surface 52 as the motor is inserted, providing a tight connection between the motor and the housing. The motor is inserted to the extent that the ends of the radial fins 68 opposite the fan 38 are aligned with the first end opening 56 of the housing. This properly positions the fan 38 relative to other component parts of the furnace blower to be assembled. The radiating fins 68 also function to provide a radial spacing 104 between the motor shell 66 and the housing interior surface 52. This radial spacing between the motor shell and the blower housing provides a flow path of air into the housing from the first end opening or the inlet end of the blower 56 that passes over and cools the motor. By constructing the motor shell 66 and the fin 68 as one monolithic piece of extruded aluminum the heat transfer ability of the motor is improved, thus enhancing the cooling effect of the air flow over the motor shell.

The combustion tube 42 is next assembled into the blower housing 34 with the input end 92 being inserted through the housing second end 46. The combustion tube input end 92 engages in a press-fit connection with the housing interior surface 52 that securely holds the combustion tube in the housing. The combustion tube input end 92 is inserted to the extent that it abuts against the ends of the motor shell fins 68, thus properly positioning the combustion tube 42 relative to the motor 36 and the blower housing 34 and properly positioning the fan 38 on the motor shaft 82 in the tapered intermediate portion of the combustion tube in close proximity to the interior surface 102 of the combustion tube.

The housing end wall 58 is then assembled onto the second end 46 of the blower housing with the end wall annular shoulder 62 fitting in a press-fit connection against the housing interior surface 52. As the end wall 58 is assembled to the blower housing 34 the combustion tube 42 passes through the end wall center opening 64. As the end wall shoulder 62 is press-fit against the housing interior surface at the housing second end 46 the end wall opening 64 is press-fit around the exterior surface 98 of the combustion tube, thus further supporting the tube in the furnace blower 32.

The furnace blower 32 constructed of the component parts described above and in the manner described above provides a more compact construction and a more economical construction for a furnace blower than that of prior art furnace blowers. The construction of the furnace blower is comprised of basically four component parts, the housing, the motor, the fan and the combustion tube. Each of these component parts are assembled to each other by press-fit connections, eliminating the need for mechanical fasteners and the time required in attaching component parts by mechanical fasteners. The stamped steel construction of the furnace blower housing also eliminates the machining steps required by prior art furnace blower housings and further reduces the manufacturing costs of the furnace blower.

While the present invention has been described by reference to specific embodiment, it should be understood that modifications and variations of the invention may be constructed without departing from the scope of the invention defined in the following claims.

What is claimed:

1. A furnace blower comprising:

a tubular housing having a length with opposite first and second openings and an interior volume of the housing, the first opening being larger than the second opening;

a motor contained in a motor shell, the motor having a shaft projecting from the motor with a fan mounted on the shaft, and the motor and fan being positioned in the housing with the housing surrounding and being spaced from the motor shell;

a plurality of radial fins projecting outwardly from the motor shell and engaging against an interior surface of the housing and thereby supporting the motor in the housing;

the radial fins are press fit in the housing; and, a combustion tube projects from the housing and the fan is positioned in the combustion tube.

2. The furnace blower of claim 1, wherein:

the plurality of fins and the motor shell are one monolithic piece.

3. The furnace blower of claim 1, wherein:

the fan has a plurality of blades that radiate outwardly from the motor shaft.

4. A furnace blower comprising:

a tubular housing having a length with opposite first and second openings and an interior volume of the housing, the first opening being larger than the second opening;

a motor contained in a motor shell, the motor having a shaft projecting from the motor with a fan mounted on the shaft, and the motor and fan being positioned in the housing with the housing surrounding and being spaced from the motor shell;

a combustion tube projecting from the housing and the fan being positioned in the combustion tube; and, the combustion tube has an input end and an output end, the input end is positioned adjacent the motor in the housing and the combustion tube extends through housing second opening to the output end of the combustion tube outside the housing.

5. The furnace blower of claim 4, wherein:

the combustion tube input end is press fit in the housing.

6. The furnace blower of claim 4, wherein:

the combustion tube tapers as the combustion tube extends from the input end to the output end.

7. A furnace blower comprising:

a tubular housing having a length with opposite first and second openings and an interior volume of the housing, the first opening being larger than the second opening;

a motor contained in a motor shell, the motor having a shaft projecting from the motor with a fan mounted on the shaft, and the motor and fan being positioned in the housing with the housing surrounding and being spaced from the motor shell;

a combustion tube projecting from the housing and the fan being positioned in the combustion tube; and, the housing has an end wall, the second opening is in the end wall and the end wall engages around the combustion tube.

8. A furnace blower comprising:

a tubular housing having a length with opposite first and second openings and an interior volume of the housing;

a motor positioned in the housing, the motor having a shaft with a fan mounted on the shaft;

a combustion tube projecting from the housing second opening, the combustion tube having an input end and an output end and the combustion tube tapering as the combustion tube extends from the input end to the output end;

the motor fan being positioned in the combustion tube between the input end and the output end;

the fan having a plurality of blades that radiate outwardly from the motor shaft; and, the combustion tube input end is press fit in the housing.

9. The furnace blower of claim 8, wherein:

the housing has an end wall, the second opening is in the end wall and the end wall engages around the combustion tube.

10. The furnace blower of claim 9, wherein:

the housing end wall engages around the combustion tube intermediate the combustion tube inlet end and outlet end.

11. A furnace blower comprising:

a cylindrical housing having a length with opposite first and second openings to an interior of the housing, the first opening being larger than the second opening, the housing having a circular end wall and the second opening is in the end wall;

a motor positioned in the housing, the motor having a shaft with a fan mounted on the shaft; and, a combustion tube having an input end and an output end, the combustion tube tapers as the combustion tube extends from the input end to the output end, and the end wall engages around the combustion tube intermediate the input end and the end.

12. The furnace blower of claim 11, wherein:

the motor fan is positioned in the combustion tube between the input end and the output end.

13. The furnace of claim 11, wherein:

the combustion tube input end is press fit in the housing.

14. The furnace blower of claim 11, wherein:

the motor is press fit in the housing.

* * * * *